United States Patent [19]

Davies

[11] 4,351,095

[45] Sep. 28, 1982

[54] METHOD OF MAKING SPARK PLUGS

[75] Inventor: Michael J. Davies, Wantage, England

[73] Assignee: United Kingdom Atomic Energy Authority, London, England

[21] Appl. No.: 45,974

[22] Filed: Jun. 6, 1979

Related U.S. Application Data

[63] Continuation of Ser. No. 859,396, Dec. 12, 1977, abandoned.

[51] Int. Cl.[3] ..... H01T 13/00

[52] U.S. Cl. ..... 29/25.12

[58] Field of Search ..... 29/25.12, 592, 630 R, 29/630 C; 228/128, 60, 131, 164, 156

[56] References Cited

U.S. PATENT DOCUMENTS

| | | | |
|---|---|---|---|
| 2,758,368 | 8/1956 | Ulam | 228/221 X |
| 2,792,272 | 5/1957 | Beggs | 228/221 X |
| 3,119,944 | 1/1964 | Lentz et al. | 313/141 |
| 3,282,660 | 11/1966 | Pendleton et al. | 228/131 X |
| 3,463,620 | 8/1969 | Winter | 228/131 X |
| 3,473,000 | 10/1969 | Siekman et al. | 219/121 LM |
| 3,548,472 | 12/1970 | Urushiwara et al. | 29/25.12 |
| 3,818,555 | 6/1974 | Yamaguchi et al. | 29/25.12 |

*Primary Examiner*—John McQuade

*Attorney, Agent, or Firm*—William R. Hinds

[57] ABSTRACT

A method of making a spark plug which is suitable for use in an internal combustion engine. The method comprises the steps of providing a tubular outer sheath of corrosion and erosion resistant metal and locating a thermally conductive core in the bore of the sheath. The sheath is worked down onto the core and the exposed end of the core is covered over by melting the outer sheath.

12 Claims, 4 Drawing Figures

METHOD OF MAKING SPARK PLUGS

This is a continuation of application Ser. No. 859,396 filed Dec. 12, 1977, now abandoned.

This invention relates to spark plugs for use with an internal combustion engine, and is particularly concerned with a method of manufacturing an electrode of a spark plug.

It is known to make the central electrode of a spark plug in the form of a copper core which is clad in a corrosion resistant outer sheath. The copper core has a higher thermal conductivity compared with the outer sheath which is typically made of a nickel alloy. If the copper core is exposed at the firing end of the electrode it is prone to erode, therefore attempts have been made to close off the exposed end of the copper core.

In British Pat. No. 549,281 it has been proposed to close off the exposed end by welding to the exposed end of the copper core a solid tip of material that is resistant to erosion and corrosion. Unfortunately it is extremely difficult to effect a satisfactory weld between the tip and both the outer sheath and the copper core. This can result in air or other inclusions being trapped between at least the tip and the core and it is also difficult to maintain good heat exchange contact between the core and the tip. Another problem arises because of the different coefficients of thermal expansion between the core, the tip, and the outer sheath. If the joint between the tip and the core, or between the tip and the outer sheath is not satisfactory the electrode may fail prematurely.

In U.S. Pat. No. 3,119,944 it is proposed to form an integral plug at the firing end of the electrode by removing part of the copper core at the firing end of the electrode and filling the cavity with a brazing material. The electrode is then heated to melt the braze material and the braze material is then allowed to solidify. This technique suffers to a certain extent from the problems enunciated above concerning the trapping of air or other inclusions as well as brazing flux at the interface between the copper core and the plug of brazing material. Also it is difficult to achieve in one heating operation a good join between the copper core and the brazing material, and between the brazing material and the outer sleeve. Furthermore, the thermal expansion of the different materials is such that if the joint between the braze material and the outer sleeve is not satisfactory the copper core in use expands and pushes the solidified plug of brazing material out of the end of the outer sheath.

A further disadvantage of using brazing materials is that it is impossible to effect a braze with the outer sleeve if the outer sleeve or the braze material has to be heated to temperatures at or above the melting point of the copper core (1083° C.) to effect the braze. Materials such as Inconel 600 (a trade mark of Henry Wiggin & Co. Ltd.) have a good resistance to erosion and corrosion but are difficult to braze using the technique disclosed in U.S. Pat. No. 3,119,944.

A further method of excapsulating the copper core in a corrosion resistant cladding is disclosed in British Pat. No. 1,425,126. In this patent a composite billet comprising a slug of core material and a slug of cladding material is cold extruded to co-extrude the core and the cladding material simultaneously. This technique cannot be used, however, for cladding cores with materials which are not capable of being cold extruded. Furthermore, hot extrusion is not possible with materials which require high temperatures which melt the copper core. An example of a material which cannot be cold extruded in the manner disclosed in British Patent No. 1,425,126 but which can be cold worked to a much lesser degree is Inconel 600.

According to the present invention a method of manufacturing an electrode for a spark plug comprises the steps of providing a tubular outer metal sheath, locating a core of thermally conductive metal co-axially in the bore of the sheath, working the sheath down on to the metal core, removing the core from a region at one end of the sheath, and melting the sheath at the end where the core is removed thereby to cause it seal over the end of the core.

Preferably the core is made of copper, or a copper based metal alloy, for example brass, or other thermally conductive metal, such as aluminium or an aluminium based metal alloy.

The other sheath is preferably made of an alloy that conforms with British Standard Alloy BS 3072/76 NA/14 (ASTM Alloy B163 or B166/168; DIN Alloy 17742 NiCr15 Fe; Werkstoff Alloy 2.4640 LN or 2.4816; U.S. Federal specification QQ-W-390). An example of such an alloy is Inconel 600 (Trade mark of Henry Wiggin & Co. Ltd.) which has a composition by weight of 0.05% C, 75.0% Ni; 15.5% Cr, 8.0% Fe. Alternatively the outer sheath may be made of nickel, nickel based alloy, molybdenum, tungsten, stainless steel, or other refractory metal that will withstand the corrosive and erosive environment within the combustion cylinder of an internal combustion engine.

The working step may comprise the step of swaging the outer sheath onto the core using a conventional swaging machine. Alternatively, or additionally the working step may comprise drawing the outer sheath down on to the core by drawing the core and outer sheath through a wire-drawing die. During the working step the diameter of the core may be reduced simultaneously as the diameter of the sheath is reduced.

Preferably the melting step is carried out using an electron beam which is directed at the end of the sheath to melt it. Preferably the electron beam melting step is carried out in an inert gas or in a partial vacuum.

Other forms of heating could be employed to melt the sheath other than an electron beam, providing care is taken to ensure that the interface between the core and the melted sheath does not become so contaminated by the inclusion of unwanted materials, or by oxidation, or by trapping air, that good contact between the core and the recast tip of sheath material is prevented or reduced. Other forms of heating that could be used are laser beams focussed on to the end of the sheath electrical induction heaters, located around the end of the sheath, or arc-image furnaces directing the arc-image at the end of the sheath. These alternative heating techniques may be carried out in an inert gas, in air, or in a partial vacuum.

A method of manufacturing an electrode intended for use as the central insulated electrode of a conventional form of spark plug in which a second electrode is secured to, or forms part of, the metal body of the plug and is earthed, will now be described by way of example in which.

Figure 1:
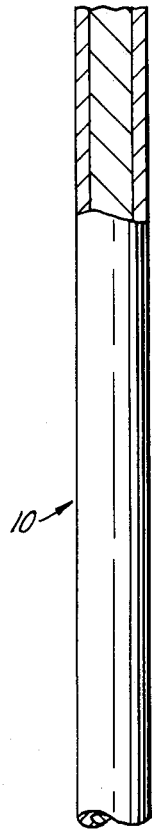
FIG. 1 shows in part section a side view of a sheathed core of electrode material.

Referring now to FIG. 1 a copper wire 1.65 mm diameter and of any desired length was degreased and then slid into the bore of a nickel sheath which had an internal diameter of 1.75 mm and an outside diameter of 3.17 mm (the sheath having also been previously degreased).

The assembly was then passed through a swaging machine, and the outer sheath was worked down on to the copper core so as to give a clad core 10 of 3 mm diameter.

Figure 2:
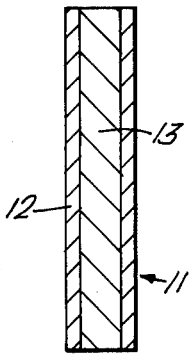
FIG. 2 shows a side sectional view of a discrete length of the sheathed core of FIG. 1.
Figure 3:
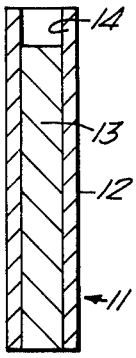
FIG. 3 shows a side sectional view of the length of sheathed core of FIG. 2 with an end portion of the core removed.
Figure 4:
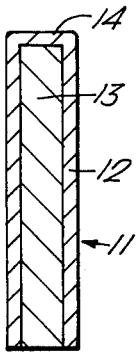
FIG. 4 shows a side sectional view of the length of sheathed core of FIG. 3 after melting of the end portion of the sheath.

Referring to FIGS. 2 and 4, discrete lengths 11 of about 25 mm long and having a sheath 12 and a core 13 were then parted off the clad core 10, and the core 13 was drilled out of one end 14 of the sheath 12 for a distance of 1.5 mm. The sheath 12 at the end 14 where the core 13 was removed, was then melted over to close off the sheath 12. The melted end 14 of the sheath 12 was then cleaned up by machining the melted end 14 to provide a flat end 14 having a thickness of Inconel 600 at the end of the core 13 of about 1 mm.

We prefer to use an electron beam heating technique to melt or weld over the open end of the sheath 12, although other forms of heating may be employed. In the electron beam heating technique, the length 11 of the clad core 10 is located vertically in the work chamber (not shown) of a high vacuum (typically $10^{-4}$ to $10^{-5}$ Torr) electron beam gun and an electron beam is focussed on to the projecting end 14 of the Inconel 600 sheath 12 to melt and cause it to fuse together. The electron beam may be a single-shot ring beam or a point focus beam which is traversed around a circular path. By operating in vacuum conditions, contamination of the exposed core 13 prior to welding over the outer sheath 12 is reduced and good metal to metal contact is ensured between the copper core 13 and the molten pool of Inconel 600 of the end 14 of the sheath 12 as it solidifies. The use of an electron beam also enables one to maintain a better control over the step of melting the end 14 of the sheath 12. Other types of electron beam guns or melting furnaces can be employed, such as for example a glow-discharge-type of device, in which case the electron beam derived from the glow-discharge is used to melt the outer sheath 12.

The electrode of the present invention is incorporated into a conventional spark plug by mounting it in a ceramic insulator (not shown). In use, that end of the electrode that has the end 14 of the sheath 12 welded over the core 13 projects into the combustion chamber of an engine and is spaced from a second electrode that is connected to the metal body of the spark plug.

An advantage of the electrode of the spark plug as manufactured according to the present invention, is that, in use, the heat of combustion is dissipated from the tip of the electrode through the thermally conductive core. In this way the electrode runs cooler and is therefore expected to last longer. This is particularly important in those cases where, to meet expected legislation on exhaust emissions from internal combustion engines, and to improve fuel economy, spark plugs are designed to have plug gaps in the region of 0.060" to 0.080". With such plugs, not only does the engine run hotter but the power dissipated by the plug is greater than with conventional spark plugs with much smaller gaps.

Although a conventional swaging machine was used, one could use a planetary ball swaging machine such as is described in British Pat. Nos. 946,407 or 1,093,661. Alternatively, the outer sheath may be drawn down on to the core by drawing the core and the sheath through a wire drawing die. During the swaging or drawing step the core may be reduced in diameter simultaneously as the outer sheath is being worked by the action of the swage or die.

By melting the end of the sheath to form a plug that seals over the core, the use of additional brazing materials, or filler materials, are avoided and the attendant problems of using brazing materials which, in general, have melting points above the melting point of the copper core is also obviated.

We claim:

1. A method of manufacturing an electrode for a spark plug comprising the steps of, providing a tubular outer metal sheath, locating a core of thermally conductive metal coaxially in the bore of the sheath, working the sheath down onto the core, removing the core from a region at one end of the sheath to form a projecting sheath portion, holding the sheath substantially vertically with said one end of the sheath uppermost, melting over the projecting sheath portion at said region to form therefrom a molten pool of sheath metal over the end of the core and provide metal to metal contact between the molten pool, the core, and the outer sheath, and allowing the molten pool to cool and solidify and thereby provide a seal of sheath metal over the entire end of the core in contact therewith and fused to the outer sheath.

2. A method according to claim 1 wherein the core is made of copper or a copper based metal alloy.

3. A method according to claim 1 wherein the core is made of aluminium or an aluminium based metal alloy.

4. A method according to claim 1 wherein the outer sheath is made of a metal or metal alloy selected from the group consisting of nickel, nickel based alloys, molybdenum, stainless steel, a refractory metal or metal alloy, an alloy conforming to U.S. Federal Specification Alloy QQ-W-390 or Inconel 600 (a trademark of Henry Wiggins and Co. Ltd.).

5. A method according to claim 1 wherein the working step comprises swaging the sheath onto the core.

6. A method according to claim 1 wherein the working step comprises drawing the core and the outer sheath through a wire-drawing-die.

7. A method according to claim 1 wherein the step of melting the end of the sheath is carried out in an inert gas.

8. A method according to claim 1 wherein the step of melting the end of the sheath is carried out in air.

9. A method according to claim 1 wherein the step of melting the end of the sheath is carried out in a partial vacuum.

10. A method according to claim 1 wherein the step of melting the end of the sheath is carried out by directing at the end of the sheath an electron beam of sufficient energy, and for sufficient time, to melt the end of the sheath.

11. A method according to claim 1 wherein the step of melting the end of the sheath is carried out by directing at the end of the sheath a laser beam of sufficient energy, and for a sufficient time to melt the end of the sheath.

12. A method of manufacturing an electrode for a spark plug comprising the steps of, providing a tubular outer metal sheath, locating a core of thermally conductive metal coaxially in the bore of the sheath, working the sheath down onto the core, removing the core from a region at one end of the sheath so as to leave a hollow sheath end projecting from the remaining core and free of contact with the core, holding the sheath substantially vertically with said one end of the sheath uppermost, melting over the hollow sheath end at said region while free of contact with the core to form therefrom a molten pool of sheath metal over the end of the core and provide metal to metal contact between the molten pool, the core, and the outer sheath, and allowing the molten pool to cool and solidify and thereby provide a seal of sheath metal over the entire end of the core in contact therewith and fused to the outer sheath.

* * * * *